US005839628A

United States Patent [19]

Freese

[11] Patent Number: 5,839,628

[45] Date of Patent: Nov. 24, 1998

[54] FOLDING ATTACHMENT FOR SHIRT BACKS

[76] Inventor: Jeffrey E. Freese, 3401 Townsend Blvd. #1206, Jacksonville, Fla. 32277

[21] Appl. No.: 829,843

[22] Filed: Apr. 1, 1997

[51] Int. Cl.[6] ..... A41H 33/00; A41H 43/00

[52] U.S. Cl. ..... 223/37; 223/1; 223/38; 2/115; 2/106

[58] Field of Search ..... 2/115, 106; 223/1, 223/37, 38, 33

[56] References Cited

U.S. PATENT DOCUMENTS

| | | | |
|---|---|---|---|
| 1,560,218 | 11/1925 | Coopersmith | 2/115 |
| 2,036,322 | 4/1936 | Ellinger | 2/115 |
| 2,137,563 | 11/1938 | Caraway | 2/120 |
| 2,244,167 | 6/1941 | McGee | 2/115 |
| 2,398,258 | 4/1946 | Seegal | 2/115 |
| 2,717,779 | 9/1955 | Currie | 223/37 |
| 3,352,466 | 11/1967 | McAllister | 223/38 |
| 5,137,190 | 8/1992 | Plaud | 223/38 |
| 5,154,329 | 10/1992 | Dorfmueller | 223/37 |

OTHER PUBLICATIONS

EPO Document 462 074 A1, Apr. 17, 1991 "Device for Hand Folding of Shirts", 223/37.

*Primary Examiner*—Bibhu Mohanty
*Attorney, Agent, or Firm*—Thomas C. Saitta

[57] ABSTRACT

A device attached to a shirt having excess material in the waist area comprising a central member and two wing members hingedly attached at each end of the central member, where each wing member is folded back against the central member to form a single, smooth pleat of the excess shirt material on each side of the wearer.

16 Claims, 3 Drawing Sheets

FOLDING ATTACHMENT FOR SHIRT BACKS

BACKGROUND OF THE INVENTION

This invention relates generally to devices used to take up slack or to create folds or pleats in garments while the garments are being worn. More particularly, the invention relates to devices which attach or are attachable to shirt backs to address the problem of excess material around the waist area.

The vast majority of people buy off-the-shelf or stock shirts rather than custom made shirts. Stock shirts are sold either by a combination of neck size and arm length measurements alone or simply in small, medium, large and extra large sizes, with no accounting for variations in torso or waist size or configuration, except for some manufacturers which also provide a choice limited to either a full cut or a tapered cut. Two people having the same neck size and arm lengths may vary greatly in the waist and torso size and shape. For any given shirt size, i.e., any particular combination of neck size and arm length, the shirt manufacturer will size the torso and waist dimensions to accommodate the largest reasonably expected dimensions, since a smaller user can wear a shirt with large waist and torso dimensions but a larger user cannot fit into waist and torso dimensions sized to fit average or thin people. This means that the majority of people wearing shirts will have excess shirt material in the lower back and waist area. This material will bunch up in an unsightly manner when the shirt tail is tucked into the waistband of pants.

Devices have been designed to address this problem. For example, in U.S. Pat. No. 1,560,218 to Coopersmith, a device is shown which consists of two elastic strips which are fastened to the middle and sides of a shirt, the elastic pulling the excess material together around the wearer's waist. The problem with this solution is that the shirt material still bunches up at the waist area, so that even though the shirt fits more snugly, the appearance of the shirt back is not improved. Another example is shown in U.S. Pat. No. 2,137,563 to Caraway. Caraway uses an elastic strap connecting two tongue members which have clasps set back from the ends of the tongues to receive the shirt material. The device is cumbersome, since adjustment by a buckle is necessary, difficult to properly size and attach, and the buckles and clasps will be uncomfortable to the wearer. The device also suffers from the use of elastic, which will cause the material to bunch. A third approach is seen in U.S. Pat. No. 2,398,258 to Seegal, in which the apparatus is a waistband extending across the back of the shirt which has a number of snaps spaced thereon. An interior tab and an exterior tab are attached at the side seams. The excess material is bunched between the two tabs, which are snapped into the waistband. This device must be formed as an integral component of the shirt, has uncomfortable snaps and the excess material is likewise gathered in an unsightly bunch.

It is an object of this invention to provide a device which addresses the problem of excess shirt material in the waist and back area, which is simple in construction, application and use, which can be permanently or temporarily attached to the shirt, and which creates a neat, folded pleat to each side of the shirt back without any bunching of the material or discomfort to the wearer. It is a further object to provide such a device which is constructed of relatively inexpensive materials such as cardboard or plastic, and which does not use elastic to bunch a portion of the shirt material into a smaller lateral distance. It is a still further object to provide such a device which mainly comprises a three member combination of relatively thin, relatively rigid members in a tri-fold configuration, where the two outer wing members fold back against the central member, so that the excess shirt material is folded in a precise pair of flat pleats on the back of the wearer.

SUMMARY OF THE INVENTION

The invention comprises in general a device attached to a shirt back for precisely folding excess shirt material in the back, waist and torso area to provide a more tailored fit when the shirt is worn and tucked into pants. The device comprises an elongated central member and two elongated outer wing members, the central member connecting the two wing members. The central member and the wing members are relatively very thin in cross-section, preferably flat and made from a relatively rigid material such as cardboard or plastic. The length of the central member is preferably from 6 to 10 times greater than its height, the length of each of the wing members is preferably from 2 to 6 times its height, and the central member is preferably longer than either of the wing members. Each wing member is hingedly attached to an end of the central member in a manner which allows the wing members to fold back against the central member. The device is provided with attachment means to permanently or temporarily attach all three members of the device to a shirt. The attachment means may comprise, for example, stitching, riveting or an adhesive applied to one side of the central and wing members. The device is attached to the shirt at a position so as to extend across the back of the wearer at the waist area. The wing members are then folded inwardly back against the central member, which creates a folded smooth pleat of shirt material on each side which is covered by the flat shirt material extending across the length of the central member.

DETAILED DESCRIPTION OF THE INVENTION

With reference to the drawings, the invention will now be described in detail with regard for the best mode and the preferred embodiment. The invention comprises in general a device for smoothly and easily creating dual pleats or folds of material on the back of a shirt in order to take up any excess shirt material in the waist and torso area, in effect tapering a shirt to better fit the torso and waist of the wearer while simultaneously providing a pleasing visual presentation to others.

Figure 1:
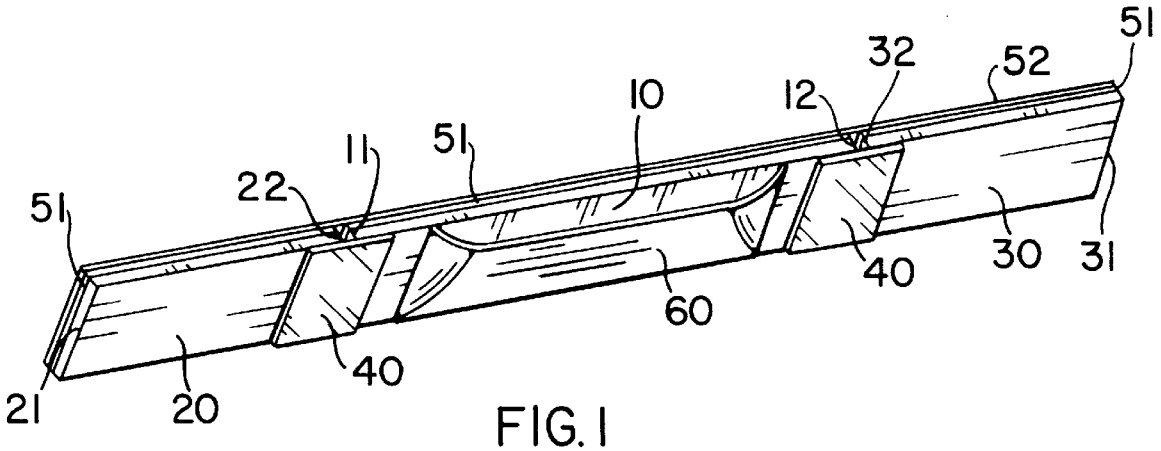
FIG. 1 is a perspective view of the invention.

As seen in FIG. 1, the device mainly comprises a central member 10 and two lateral or wing members 20 and 30. Central member 10 has a first end 11 and a second end 12. First wing member 20 has a free end 21 and a joined end 22, where joined end 22 is hingedly connected to first end 11 of central member 10 by a hinge member 40. Second wing member 30 has a free end 31 and a joined end 32, where joined end 32 is hingedly connected to second end 12 of central member 10 by another hinge member 40. The two hinge members 40 allow the first wing member 20 and the second wing member 30 to pivot or fold relative to the central member 10. Hinge members 40 may comprise any suitable means with allows folding movement between the components, such as a flexible material attached to the members 10, 20 and 30 by adhesives, stitching or other suitable means, or the folding movement may be accomplished by means such as a pair of crimp, seam or score lines formed in or created across the material composing the central member 10, first wing member 20 and second wing member 30. In the first construction, the central member 10 and wing members 20 and 30 are separate pieces, while in the second construction they are constructed of a single piece of material and the score lines define the members 10, 20 and 30. The device may be constructed such that the passive, non-stressed position is either a flat or a folded configuration. The hinge members 40 are preferably configured at a angle not perpendicular to the longitudinal axis of central member, such that the longitudinal axis of each wing member 20 and 30 when folded completely back against central member 10 is non-parallel with the longitudinal axis of the central member. Preferably, the wing members 20 and 30 will angle upward in the folded configuration, as shown in FIGS. 4 and 6, as this allows the longitudinal axis of each wing member 20 and 30 to be at or near perpendicular to the interior fold line of each shirt material pleat 95, which will angle down from the shoulder area.

The central member and two wing members 20 and 30 are generally elongated members composed of thin, relatively rigid material which has some stiffness even when relatively thin in cross-section, such as for example a stiff paperboard, cardboard or plastic material. Dimensions may vary, but it is preferred that the length of central member 10 be approximately six to ten times the height, the length of each of the wing members 20 and 30 be approximately two to six times the height, and that the length of each of the wing members 20 and 30 be approximately half the length of the central member 10. Thus for a preferred height of approximately one inch, central member 10 would preferably range in length from six to ten inches and each wing member 20 and 30 would range in length from three to five inches. In general, the particular length of the central member 10 is preferably determined by the waist size of the wearer, such that the length is approximately one fourth of the wearer's total waist measurement.

Figure 2:
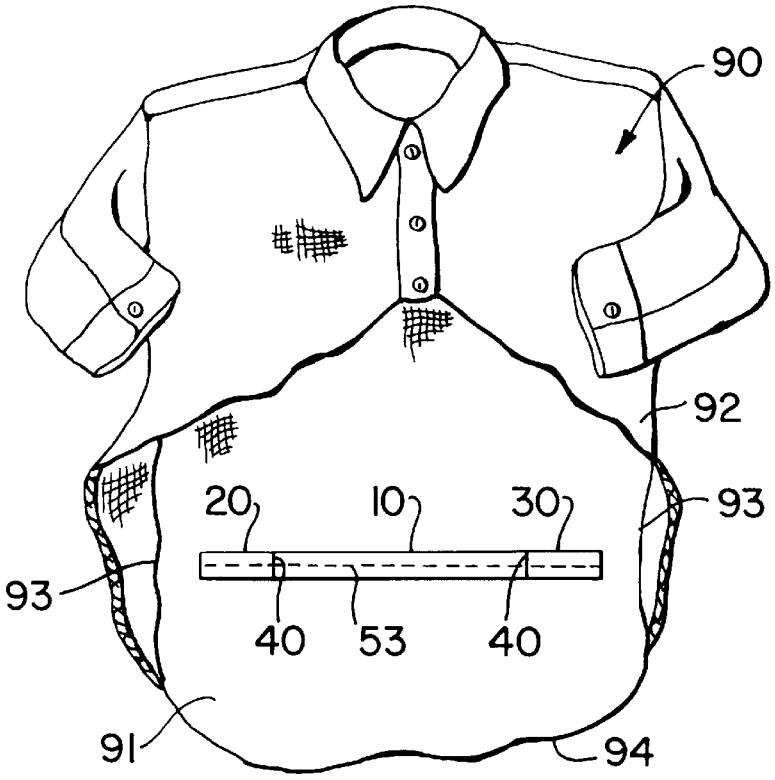
FIG. 2 is a view of the invention shown attached to the inside back of a shirt.
Figure 3:
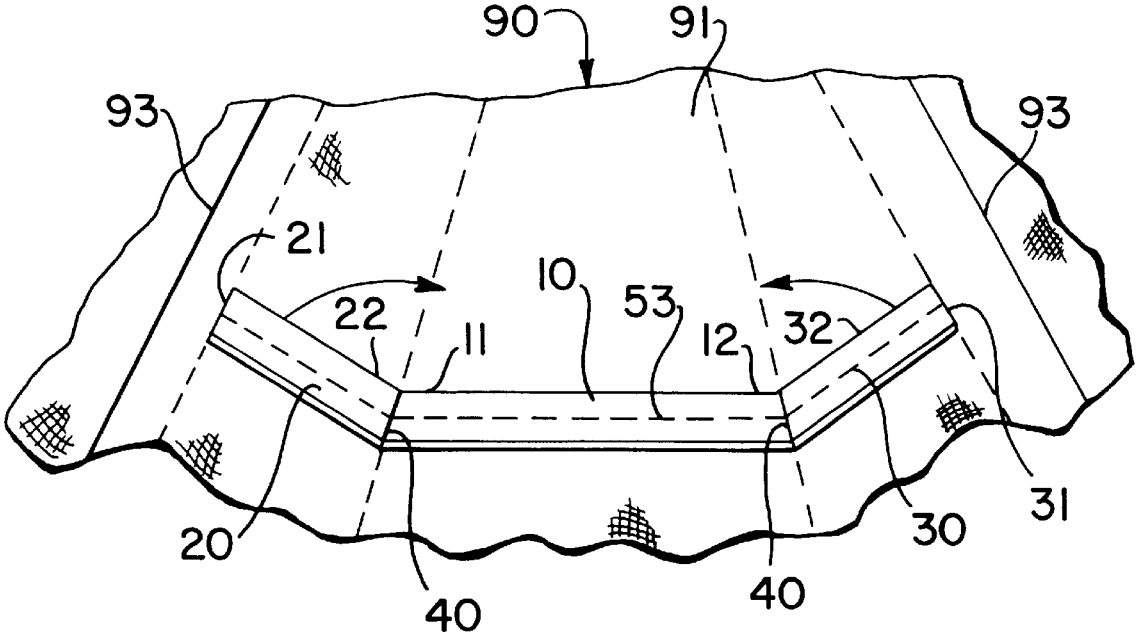
FIG. 3 is a view of a portion of FIG. 2 showing the device slightly folded.
Figure 4:
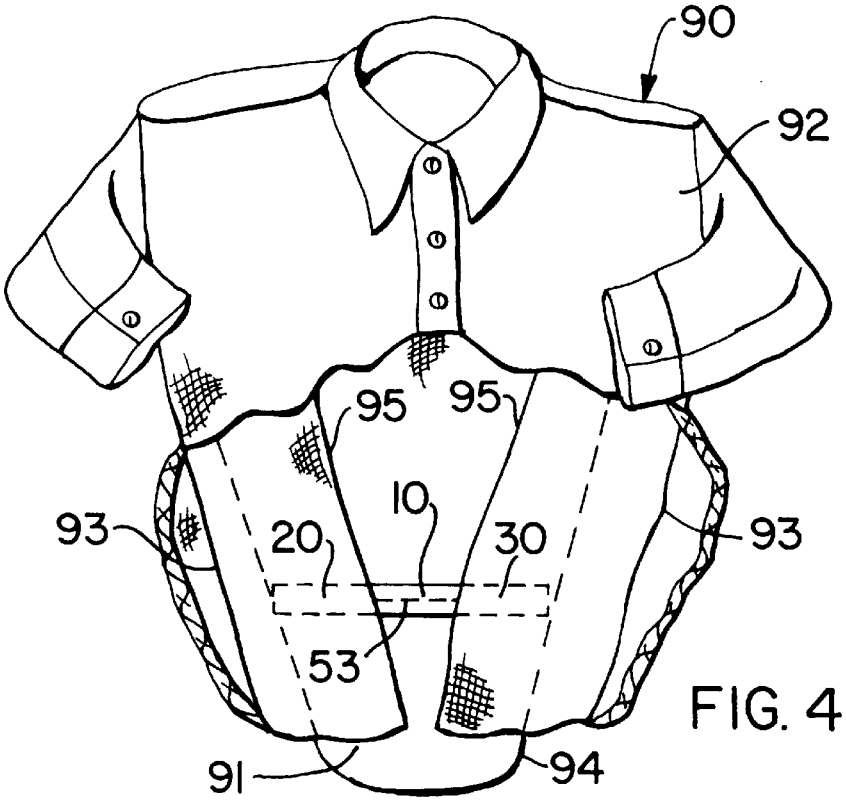
FIG. 4 is a view of the interior of the shirt in FIG. 2 with the invention in the folded configuration.
Figure 5:
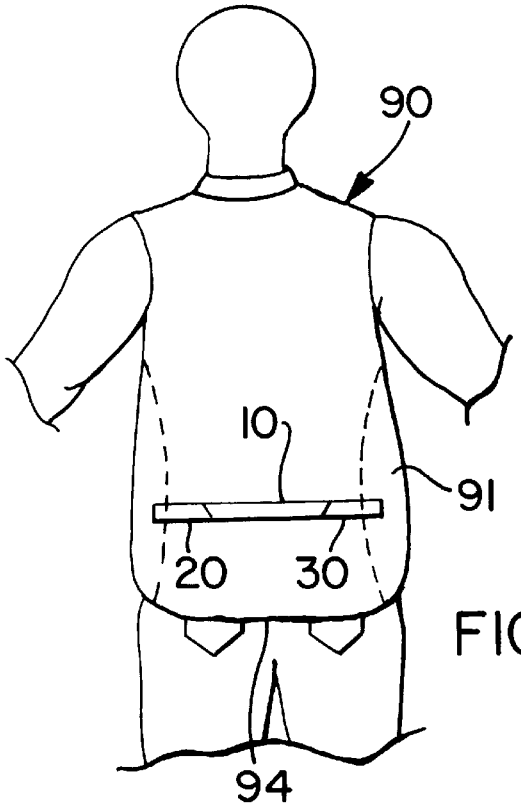
FIG. 5 is a view of the invention as attached to the exterior of a shirt.
Figure 6:
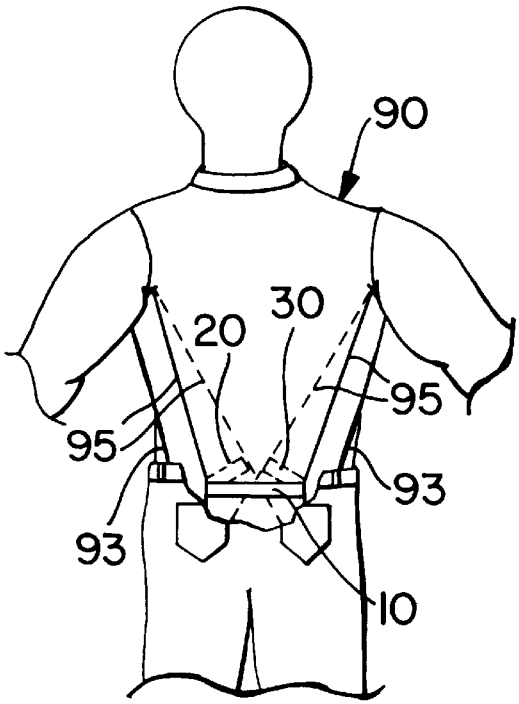
FIG. 6 is a view of the exterior of the shirt in FIG. 5 with the invention in the folded configuration.

The device is attached, either permanently or temporarily, to either the interior side 91, as in FIGS. 2 through 4, or exterior side 92, as in FIGS. 5 and 6, of a shirt 90, above the tail 94 and between the side seams 93 in a generally horizontal manner. The method of attachment may comprise stitching 53 as shown in FIGS. 3 through 5, or the device may be attached by an adhesive layer 51, as shown in FIGS. 5 and 6. If an adhesive layer 51 is used to attach the device either permanently or temporarily, it is preferred that a release member 52 consisting of a removable cover layer be provided, as shown in FIG. 1, if the device is to be applied by the consumer and not the manufacturer. Other alternative attachment means, such as mechanical fasteners, hook and pile fasteners, providing a pocket in the shirt to receive the device, or similar means may also be used. While attachment to the interior side 91 of shirt 90 will better insure that the device remains hidden, it is not essential in that the device is to be attached on a lower portion of shirt 90 which will be tucked into the waistband of the wearer's pants, so that in either event the device will not be visible when worn. The device may be attached at independent points rather than continuously, as long as the shirt 90 is at a minimum attached at or adjacent each free end 21 and 31, but it is preferred that the shirt 90 be attached continually along central member 10 and wing members 20 and 30.

With the device properly attached to shirt 90, the wearer neatly takes in the excess shirt material by folding the free ends 21 and 31 of each of the wing members 20 and 30 inwardly a full 180 degrees about hinge members 40, so that each wing member 20 and 30 is generally parallel to central member 10, as seen in FIGS. 4 and 6, and free ends 21 and 31 are now adjacent or overlapping. When a wing member 20 or 30 is folded, a portion of the excess shirt material is brought towards the center of the back, which in turn pulls the side seam 93 more closely to the waist of the wearer. In effect, the circumferential dimension of the shirt 90 at the point of attachment is reduced by the length of the two wing members 20 and 30. Thus, for a device with each wing member 20 and 30 having a length of four inches, four inches of material on each side are folded toward the middle, resulting in a total reduction of eight inches in circumferential shirt size. Additionally, the effective reduction is accomplished without bunching the shirt material. Because the wing members 20 and 30, as well as central member 10, are relatively stiff and rigid, the material folds on each side to form a single pleat 95 with a smooth, flat surface. By folding the wing members 20 and 30 inwardly, regardless of whether they are positioned on the interior side 91 of exterior side 92 of shirt 90, the pleats 95 are created underneath the shirt material attached to the central member 10, such that the back of the shirt 90 presents a broad, visually-pleasing, unfolded region across the length of the central member 10.

In the most preferred embodiment, the device is attached to the exterior of the shirt and is further provided with tucking means 60 which is attached or mounted onto the side of the central member 10 which is not attached to the shirt 90. Tucking means may be a flap or pocket of cloth material or the like, as shown in FIG. 1, or any other means which provides a gripping or contact surface to assist the wearer in pushing the device into the waistband of the pants. By inserting fingers into the tucking means 60, the device and shirt are easily tucked into the pants after folding.

Where the device is manufactured for temporary attachment to shirts 90 by the end user, it is contemplated that it may be composed of an inexpensive material to allow for cost-effective use on a single or limited number re-use basis. Where adhesive layers 51 are for temporary attachment, multiples of the device can be manufactured or sold in a multi-layered pad configuration without need for the release member 52, such that individual devices are removed from the pad when needed.

It is understood that equivalents and substitutions for various components may be obvious to those skilled in the art, and the true scope and definition of the invention therefore is to be as set forth in the following claims.

I claim:

1. A folding attachment device for shirt backs, the device comprising a first wing member having a free end and a joined end, a second wing member having a free end and joined end, and a central member having a first end and a second end, said first wing member, said second wing member and said central member being composed of a thin, stiff material, said joined end of said first wing member being hingedly connected to said first end of said central member and said joined end of said second wing member being hingedly connected to said second end of said central member by hinge members, and attachment means to attach said device to the lower back portion of a shirt, where said central member, said first wing member and said second wing member each have a longitudinal axis and said hinge members are non-perpendicular to said longitudinal axis of said central member, such that said first wing member longitudinal axis and said second wing member longitudinal axis are nonparallel to said central member longitudinal axis when said hinge members are folded.

2. The device of claim 1, where said hinge members are composed of a flexible material and are attached to said first wing member, said central member and said second wing member.

3. The device of claim 1, where said first wing member, said central member and said second wing member are constructed of a single piece of material and said hinge members are a pair of crimp lines formed in said single piece of material and defining said first wing member, said central member and said second wing member.

4. The device of claim 1, where said attachment means comprises an adhesive.

5. The device of claim 1, where said attachment means comprises stitching.

6. The device of claim 1, where said central member has a length and a height, said central member length being approximately six to ten times said central member height, and where said first and said second wing members each have a length and a height, each said wing member length being approximately two to six times said wing member height, and further where each said wing member length is approximately half said central member length.

7. The device of claim 1, further comprising tucking means attached to said central member, said tucking means comprising a contact surface mounted onto said central member for pushing the device below a pants waistband.

8. The device of claim 7, where said tucking means comprises a pocket.

9. A combination folding attachment device and shirt, said shirt comprising a tail, side seams, an interior side and an exterior side, said device comprising a first wing member having a free end and a joined end, a second wing member having a free end and joined end, and a central member having a first end and a second end, said first wing member, said second wing member and said central member being composed of a thin, stiff material, said joined end of said first wing member being hingedly connected to said first end of said central member and said joined end of said second wing member being hingedly connected to said second end of said central member by hinge members, and attachment means to attach said device to said tail between said side seams of said shirt, where said central member, said first wing member and said second wing member each have a longitudinal axis and said hinge members are non-perpendicular to said longitudinal axis of said central member, such that said first wing member longitudinal axis and said second wing member longitudinal axis are non-parallel to said central member longitudinal axis when said hinge members are folded.

10. The device of claim 9, where said hinge members are composed of a flexible material and are attached to said first wing member, said central member and said second wing member.

11. The device of claim 9, where said first wing member, said central member and said second wing member are constructed of a single piece of material and said hinge members are a pair of crimp lines formed in said single piece of material and defining said first wing member, said central member and said second wing member.

12. The device of claim 9, where said attachment means comprises an adhesive.

13. The device of claim 9, where said attachment means comprises stitching.

14. The device of claim 9, where said central member has a length and a height, said central member length being approximately six to ten times said central member height, and where said first and said second wing members each have a length and a height, each said wing member length being approximately two to six times said wing member height, and further where each said wing member length is approximately half said central member length.

15. The device of claim 9, further comprising tucking means attached to said central member, said tucking means comprising a contact surface mounted onto said central member for pushing the device below a pants waistband.

16. The device of claim 15, where said tucking means comprises a pocket.

* * * * *